US008109019B2

(12) United States Patent
Logue

(10) Patent No.: US 8,109,019 B2
(45) Date of Patent: Feb. 7, 2012

(54) PRESENTATION PAD SUPPORTING USE OF EACH OF TWO SHEET SIDES

(76) Inventor: C. Robert Logue, Chicago, IL (US)

( * ) Notice: Subject to any disclaimer, the term of this patent is extended or adjusted under 35 U.S.C. 154(b) by 269 days.

(21) Appl. No.: 12/383,473

(22) Filed: Mar. 24, 2009

(65) Prior Publication Data

US 2010/0244426 A1 Sep. 30, 2010

(51) Int. Cl.
*B42F 17/00* (2006.01)

(52) U.S. Cl. ..... 40/390; 40/398; 281/23

(58) Field of Classification Search ..... 40/531, 40/535, 530, 372, 376, 398, 403, 904; 281/DIG. 1, 281/38, 27.3, 23; 402/60
See application file for complete search history.

(56) References Cited

U.S. PATENT DOCUMENTS

| | | | | | |
|---|---|---|---|---|---|
| 1,248,488 | A | * | 12/1917 | Harriss | 281/15.1 |
| 1,805,268 | A | * | 5/1931 | Tresback | 281/27.3 |
| 1,913,969 | A | * | 6/1933 | Wood | 281/23 |
| 3,325,934 | A | * | 6/1967 | Rhude | 40/530 |
| 4,183,162 | A | * | 1/1980 | Applebaum et al. | 40/530 |
| 4,289,330 | A | * | 9/1981 | Wiermanski | 281/21.1 |
| 4,352,583 | A | * | 10/1982 | Errichiello | 402/75 |
| 4,616,851 | A | * | 10/1986 | Mann | 281/43 |
| 4,620,725 | A | * | 11/1986 | Maehashi | 281/45 |
| 5,010,671 | A | | 4/1991 | Stonehouse | |
| 5,180,191 | A | * | 1/1993 | Biba | 281/45 |
| 5,697,595 | A | | 12/1997 | Sperber | |
| 5,709,409 | A | * | 1/1998 | Engel | 281/29 |
| 5,769,477 | A | * | 6/1998 | Lehrer | 294/138 |
| 6,647,652 | B1 | | 11/2003 | Seiber et al. | |
| 6,698,796 | B2 | * | 3/2004 | Kurahashi | 281/29 |
| 6,889,952 | B2 | | 5/2005 | Cook et al. | |
| 7,178,778 | B2 | | 2/2007 | Lee et al. | |
| 2006/0061083 | A1 | * | 3/2006 | Didde | 281/21.1 |

* cited by examiner

*Primary Examiner* — Gary Hoge
(74) *Attorney, Agent, or Firm* — Patrick Reilly; Colin Fowler

(57) ABSTRACT

A flip-chart comprising at least two sheets bound by a linear attachment spine. The spine is positioned at a substantially vertical angle. The sheets are releasably securable to the spine and to optionally to a chart cover by means of support pegs. The sheets are adapted for writing on both sides thereon, and each sheet is removable from the pad.

20 Claims, 18 Drawing Sheets

PRESENTATION PAD SUPPORTING USE OF EACH OF TWO SHEET SIDES

BACKGROUND OF THE INVENTION

1. Field of the Invention

The present invention relates generally to the efficient use of sheets of as collected in presentation pads. The present invention more particularly relates to an invented presentation pad that allows the usage of both sides of a sheet rather than just a front side of a sheet.

2. Description of the Background Art

The prior art and related art includes efforts to provide presentation pads for use in commercial, educational, indoor and outdoor settings. These prior presentation pads do not support the convenient use of both sides of the sheets of the pad, i.e., a display pad such as a flip chart. Flip chart sheets of paper pages, for example, are thus often discarded with a side of many discarded sheets unused. This wastage of paper is contrary to an increasing public desire to reduce the environmental burden of paper product manufacture and disposal.

There is therefore a long felt need to provide a presentation pad design that enables the convenient use of both sides of most or all of the sheets of the presentation sheets.

The principal objective of the present invention is, therefore, to provide a presentation pad, i.e., a "turn chart", configured to allow a user to more conveniently write on both sides of the sheets of the turn chart. This and other objectives of the invention will be apparent to those skilled in this field from the following description of preferred embodiments of the invention.

SUMMARY OF THE INVENTION

Towards this object and other objects that will be made obvious in light of this disclosure, a first preferred configuration of the present invention includes a presentation pad comprising at least two sheets bound by a linear attachment spine. The spine is positioned at a substantially vertical angle and joins a front cover and a back cover, wherein the sheets are attached to the linear attachment spine along one edge of each sheet and between the two front cover and the back cover. The sheets are releasably securable to each cover by means of separate support pegs. Each sheet may be adapted for writing on both sides thereon, and each sheet may be removable from the linear attachment spine.

INCORPORATION BY REFERENCE

U.S. Pat. No. 5,010,671 (Inventor: Stonehouse, D. R.; issued on Apr. 30, 1991) tiled "Flip chart pad"; U.S. Pat. No. 5,697,595 (Inventor: Sperber, G.; issued on Dec. 16, 1997) titled "Flip chart"; U.S. Pat. No. 6,647,652 (Inventors: Seiber, et al.; issued on Nov. 18, 2003) titled "Display board system"; U.S. Pat. No. 6,889,952 (Inventors: Cook, et al.; issued on May 10, 2005) titled "Multi-position presentation easel"; and U.S. Pat. No. 7,178,778 (Inventor: Lee, W. S.; issued on Feb. 20, 2007) titled "Portable easel" are incorporated herein by reference and for all purposes. In addition, each and all publications, patents, and patent applications mentioned in this specification are herein incorporated by reference to the same extent, in their entirety and for all purposes, as if each individual publication, patent, or patent application was specifically and individually indicated to be incorporated by reference.

BRIEF DESCRIPTION OF THE DRAWINGS

These, and further features of the invention, may be better understood with reference to the accompanying specification and drawings depicting the preferred embodiment, in which.

DETAILED DESCRIPTION OF A PREFERRED EMBODIMENT

In describing the preferred embodiments, certain terminology will be utilized for the sake of clarity. Such terminology is intended to encompass the recited embodiment, as well as all technical equivalents, which operate in a similar manner for a similar purpose to achieve a similar result.

Figure 1:
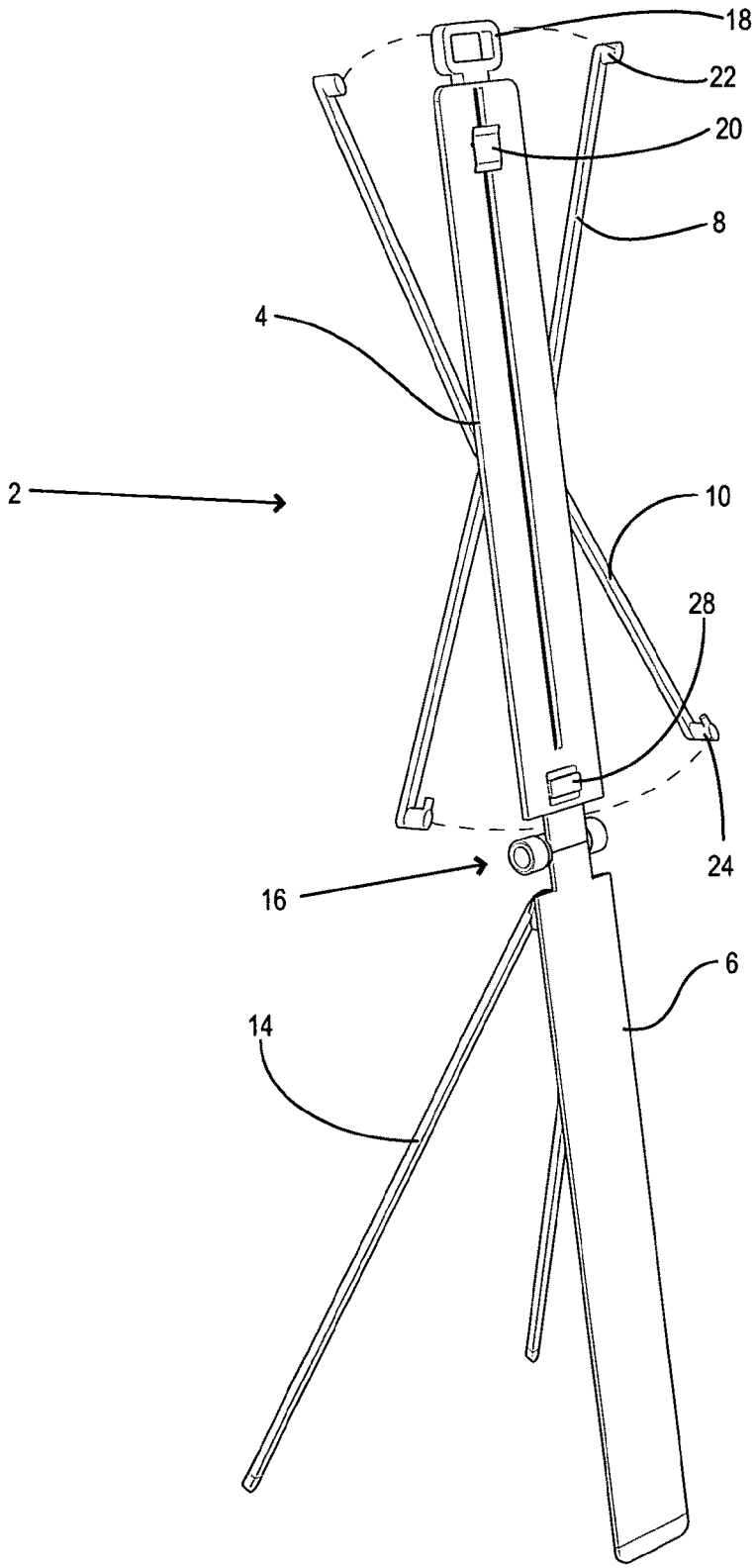
FIG. 1 is a front view of an invented easel in a set up configuration.
Figure 2:
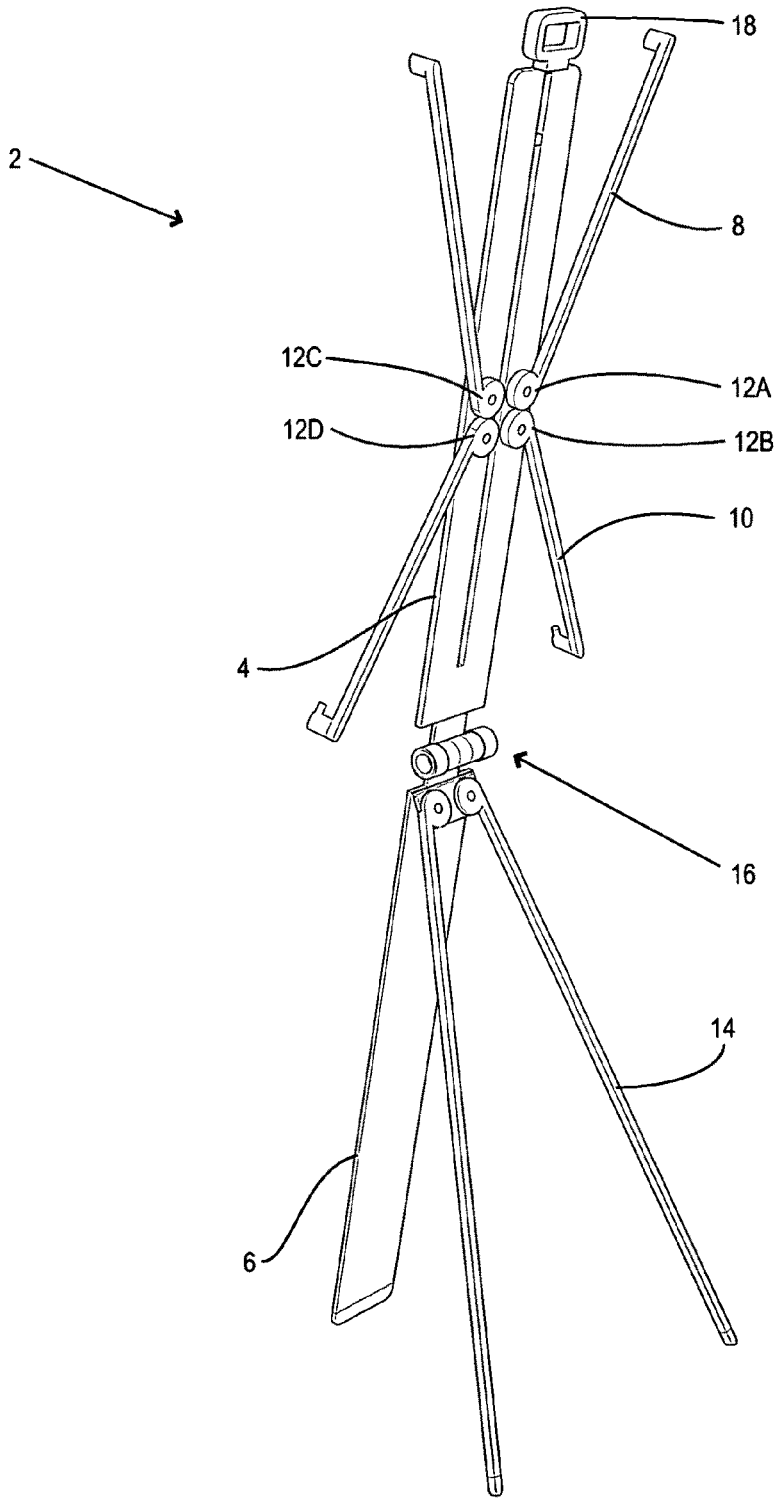
FIG. 2 is a rear view of the easel of FIG. 2 in a set up configuration.

Referring now generally to the Figures and particularly to FIGS. 1 and 2, FIG. 1 is a front view of the easel 2 in a set up configuration, FIG. 2 is a rear view of the same. The invented easel 2 includes a supporting spine 4 and a leg element 6 foldable toward each other in the manner of a clamshell, as well as a set of rotatable upper arms 8 and a set of lower arms 10 extending from specific anchor points 12A-D of the of the support spine 4, and a set of support legs 14 that may extend backwards from the top of the leg element 6. Optionally a wheel assembly 16 can be coupled between the support spine 4 and the leg element 6 with a handle 18 mounted at the top of the support spine 4 for carrying or dragging when the invented easel 2 is folded up. Just below the handle 18, mounted on the front of the support spine 4 is an optional support clip 20 which can be used to support a display pad (not shown). The upper arms 8 are configured to have at their ends, a securing feature 22 which can be used to steady a display pad. The lower arms 10 are configured to have at their ends, a holding feature 24 for bearing at least part of the weight of a display pad.

Figure 3:
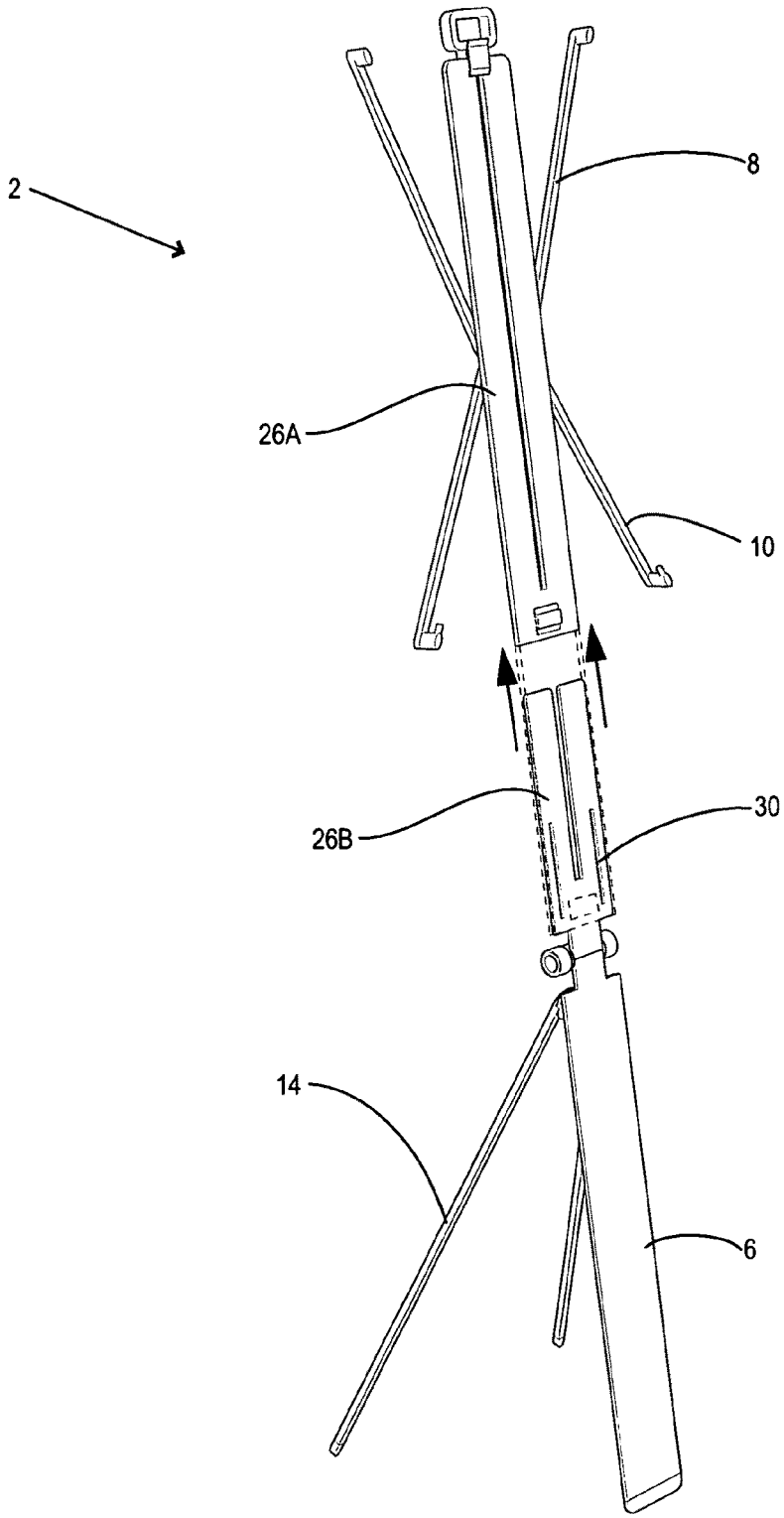
FIG. 3 is a front view of the easel of FIG. 2 in a set up configuration, depicting an adjustable height feature.
Figure 4:
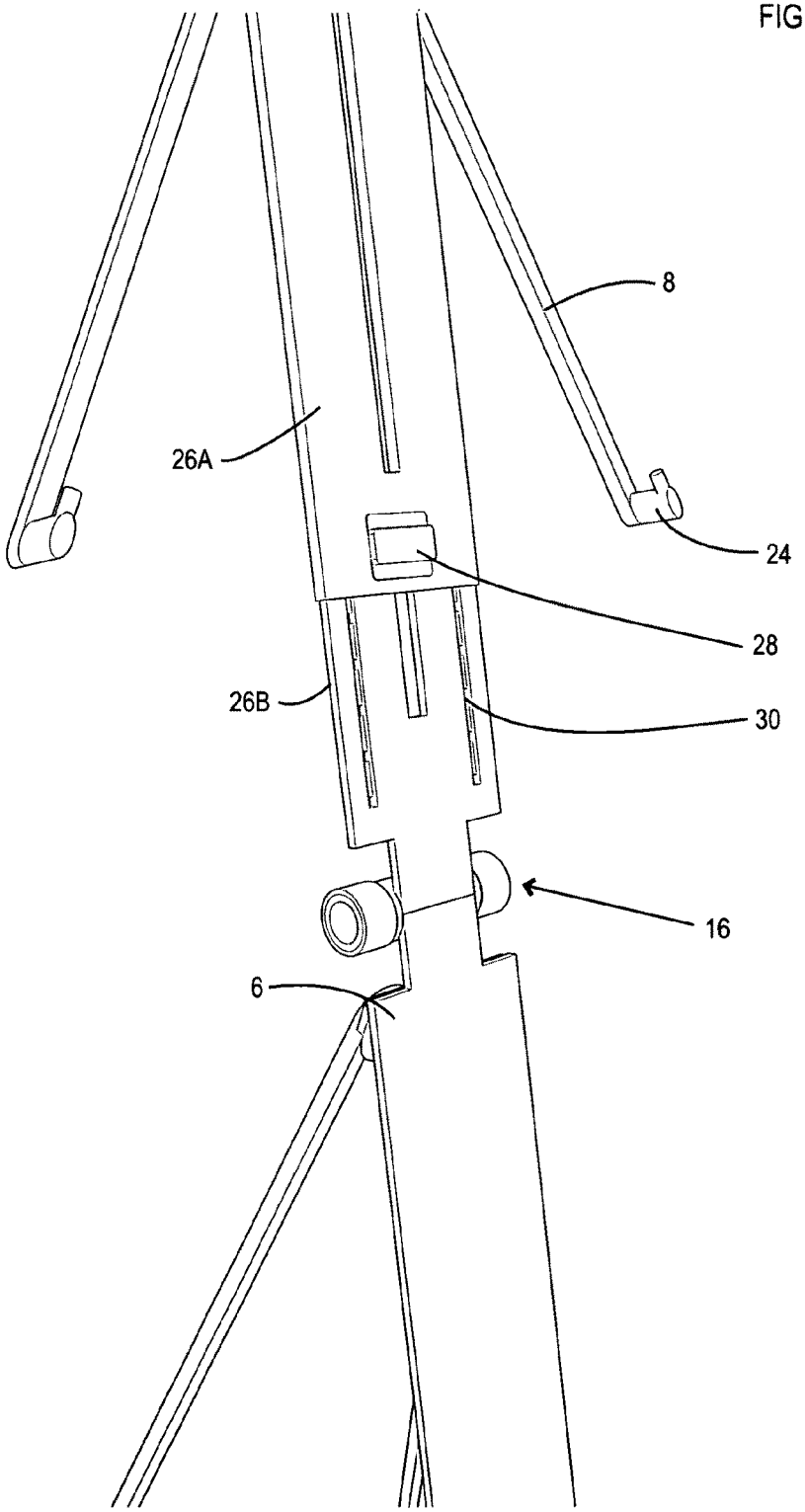
FIG. 4 is a close up view of an optional aspect of the easel of FIG. 2 having an adjustable height feature.

Referring now generally to the Figures and particularly to FIGS. 3 and 4, FIG. 3 is a front view of the invented easel 2 in a set up configuration, depicting an optional adjustable height feature 26 and FIG. 4 is a close up view of the optional adjustable height feature 26. At a support spine base 26A of the support spine 4, a locking control button 28 is affixed in order to facilitate adjustments of the easel's 2 extension from the leg element 6 and additionally can bear weight of the display pad.

According to the adjustable height feature 26, the support spine 4 is comprised of the support spine base 26A and a support spine extension 26B. The support spine base 24A is attached by a locking track mechanism 30 to the support spine extension 26B. The locking control button 28 is configured to adjustably engage and disengage with the locking track mechanism 30 by user manipulation of the locking control button 28. The position of the support spine base 26A along the locking track 30 is adjustable in height. The extension of the support spine base 26A in relation to the wheel assembly 16 is adjustable along the locking track mechanism 30 user manipulation of the locking control button 28.

Figure 5:
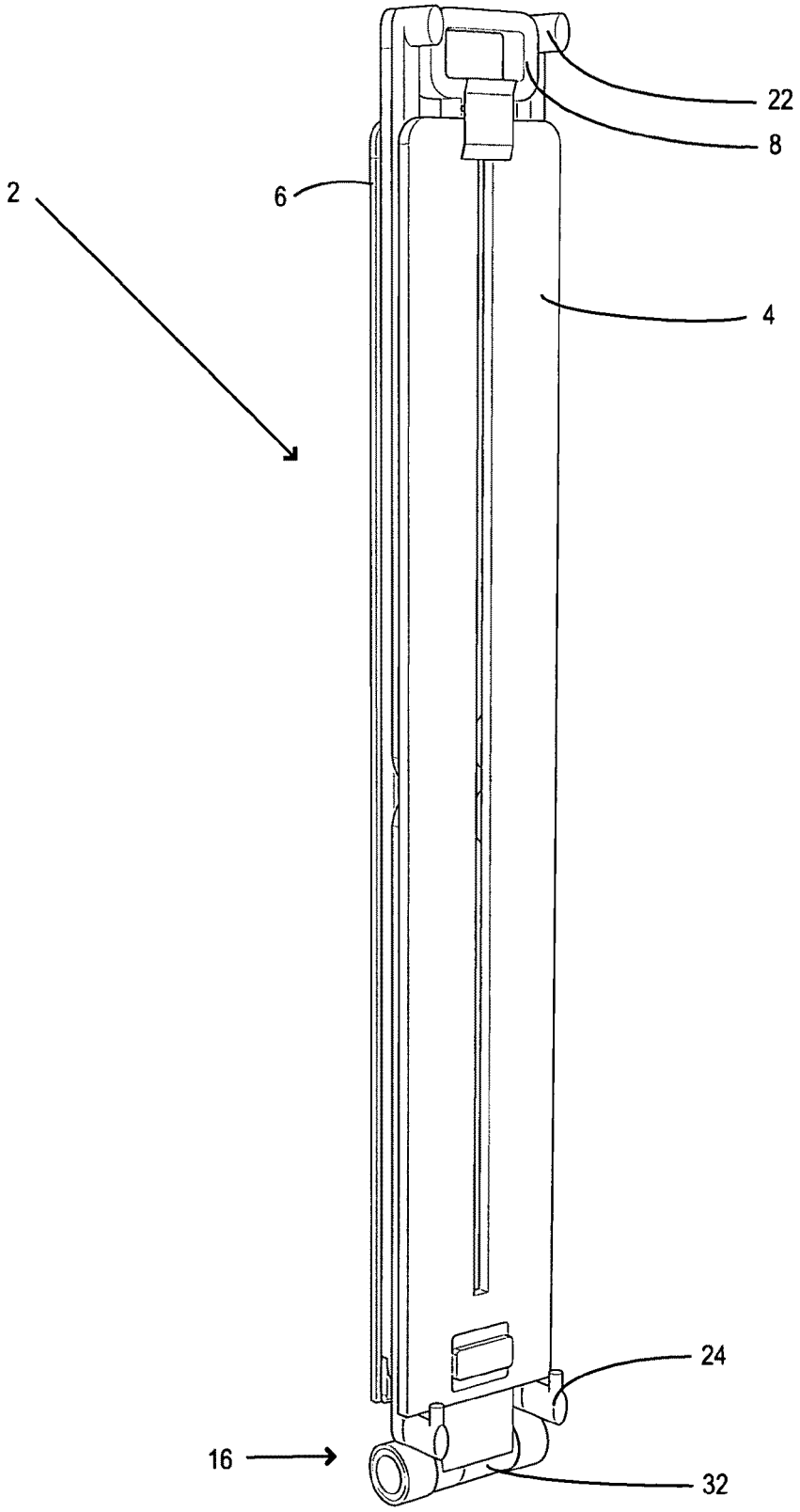
FIG. 5 is a front view of the easel of FIG. 2 in a travel configuration.
Figure 6:
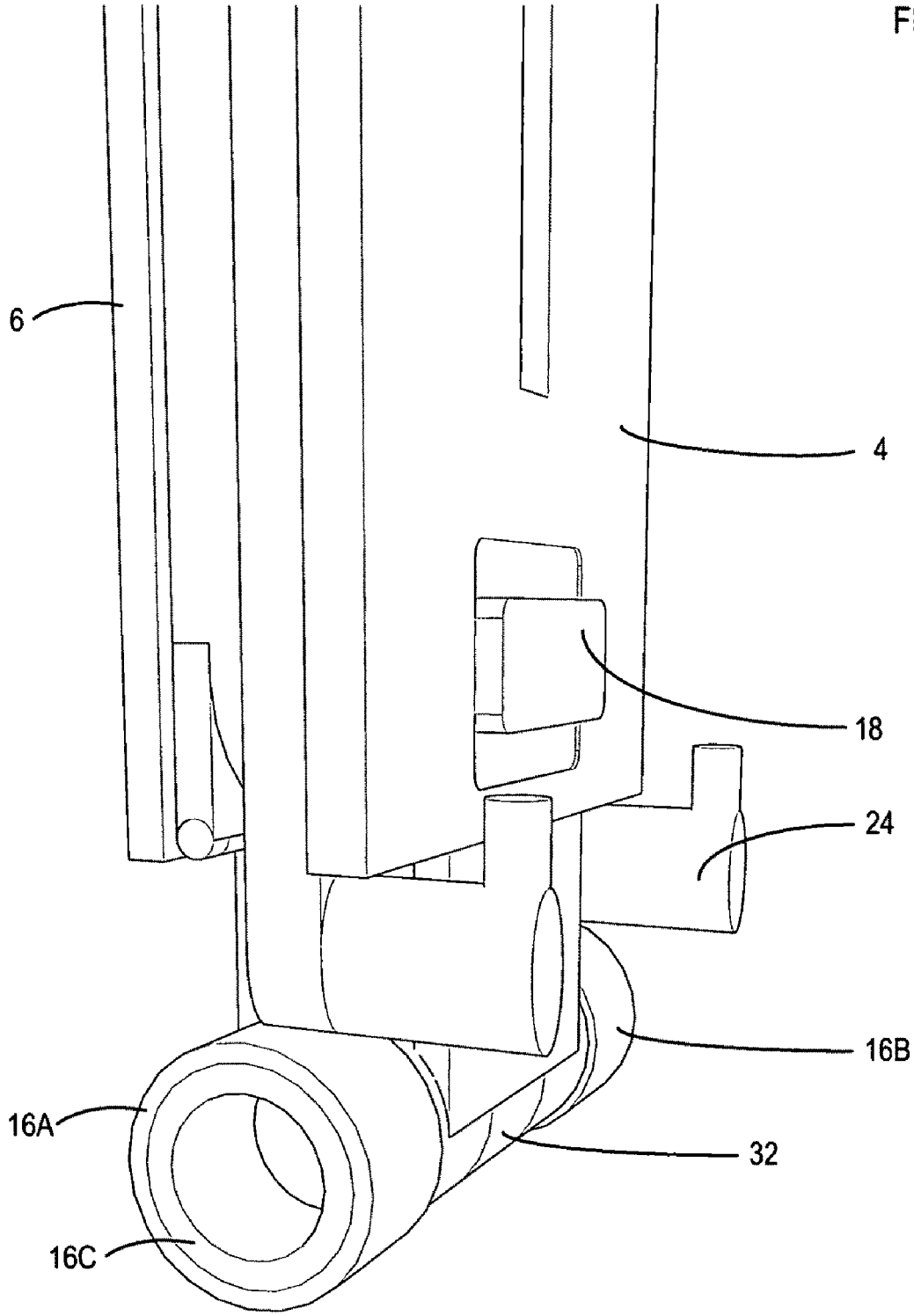
FIG. 6 is a close up view of the easel of FIG. 2 in a travel configuration.
Figure 7:
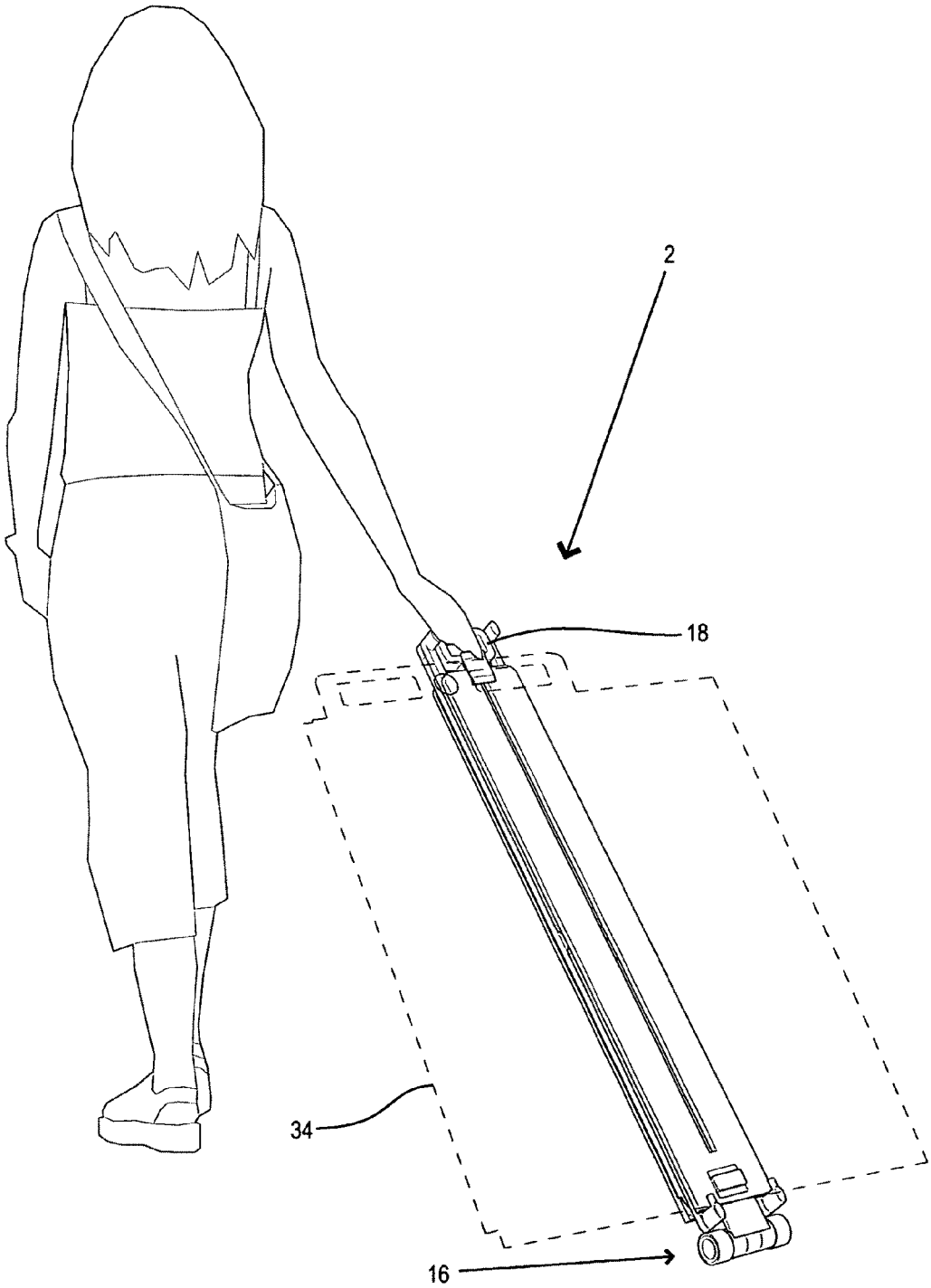
FIG. 7 is a view of the easel of FIG. 2 being used in a travel configuration.

Referring now generally to the Figures and particularly to FIGS. 5, 6 and 7, FIG. 5 is a front view of the invented easel 2 in a travel configuration, FIG. 6 is a close up view of the easel 2 in a travel configuration, FIG. 7 is a view of the easel 2 being used in a travel configuration. The invented easel 2 can be folded up in a more compact form in order to transport more easily. Between the leg element 6 and the support spine 4, a pivot point 32 which uses a suitable resistance or locking mechanism known in the art to sustain an affixed position is coupled to a wheel assembly 16 in order to make dragging the invented easel 2 more effortless. The wheel assembly includes a first wheel 12A, a second wheel 12B and a circular support 12C.

Figure 8:
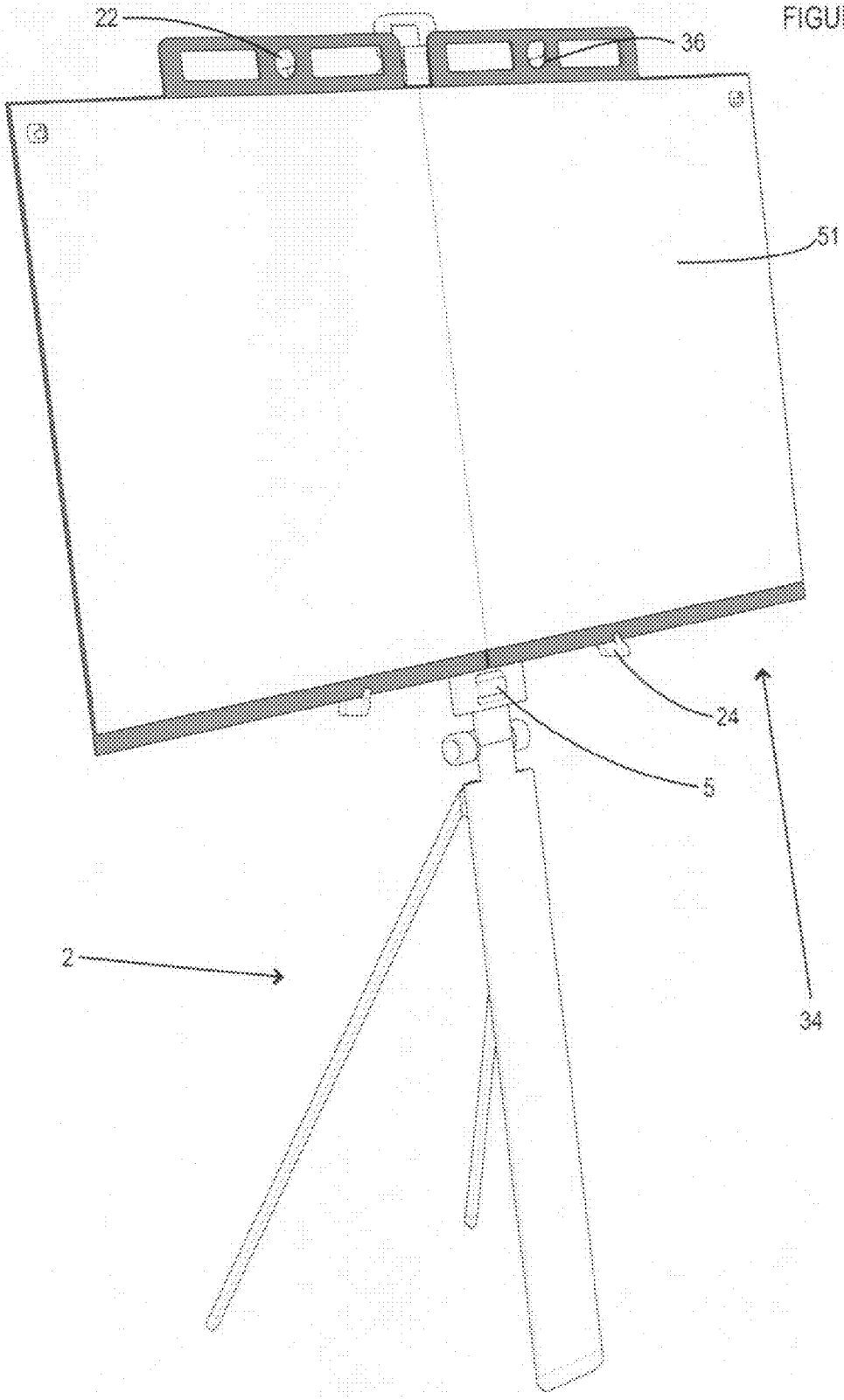
FIG. 8 is a front view of the easel of FIG. 2 being used in conjunction with an invented turn chart.
Figure 9:
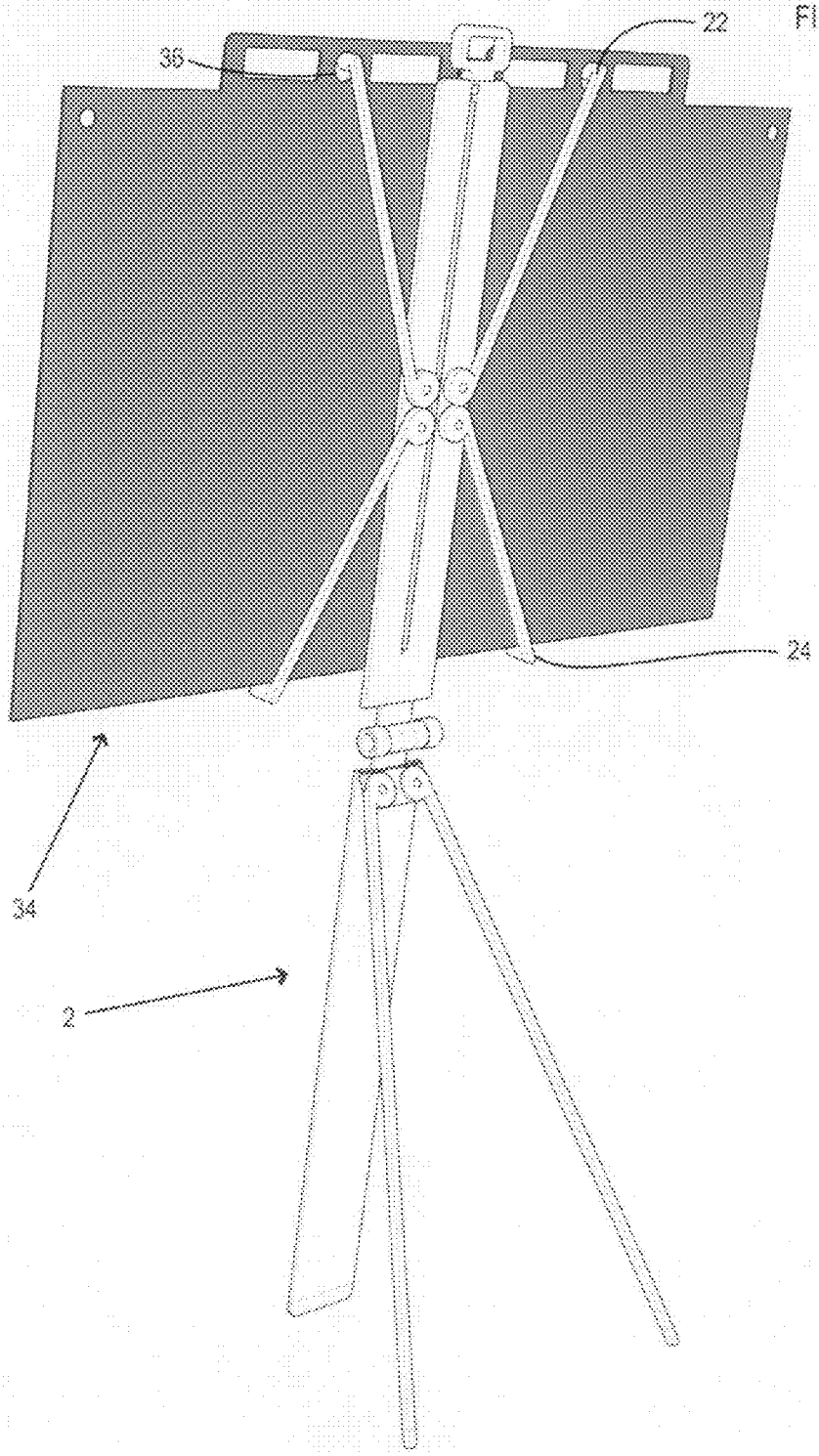
FIG. 9 is a rear view of the easel of FIG. 2 being used in conjunction with an invented turn chart.

Referring now generally to the Figures and particularly to FIGS. 8 and 9, FIG. 8 is a front view of the easel 2 being used in conjunction with an invented presentation pad 34 (hereinafter "turn chart" 34), while FIG. 9 is a rear view of the easel 2 being used in conjunction with an invented turn chart 34. In these figures the securing feature 22 of the upper arms 8 of the invented easel 2 is shown protruding through an aperture 36 of the turn chart 34. The securing features 22 stabilize the turn chart 34 by preventing motion. The holding features 24 of the lower arms 10 of the invented easel 2 are shown steadying a turn chart 34.

It is understood that the easel 2 may be configured to support a prior art presentation pad, such as a LEGACY ROTAFOLIO PAD™ presentation pad, part number LOP21300, presentation pad, as marketed by Legacy Office Products of Indianapolis, Ind., or a LETR-TRIM PERFORATION™ presentation pad, part number 7900, as marketed by TOPS Business Forms of St. Charles, Ill. It is further understood that the turn chart 34 may be configured shaped and sized to be supported by a prior art flip chart easel, such as a prior art easel suitable to support a prior art presentation pad, such as a LEGACY ROTAFOLIO PAD™ presentation pad, part number LOP21300, presentation pad, as marketed by Legacy Office Products, or a LETR-TRIM PERFORATION™ presentation pad, part number 7900, as marketed by TOPS Business Forms of St. Charles, Ill.

Figure 10:
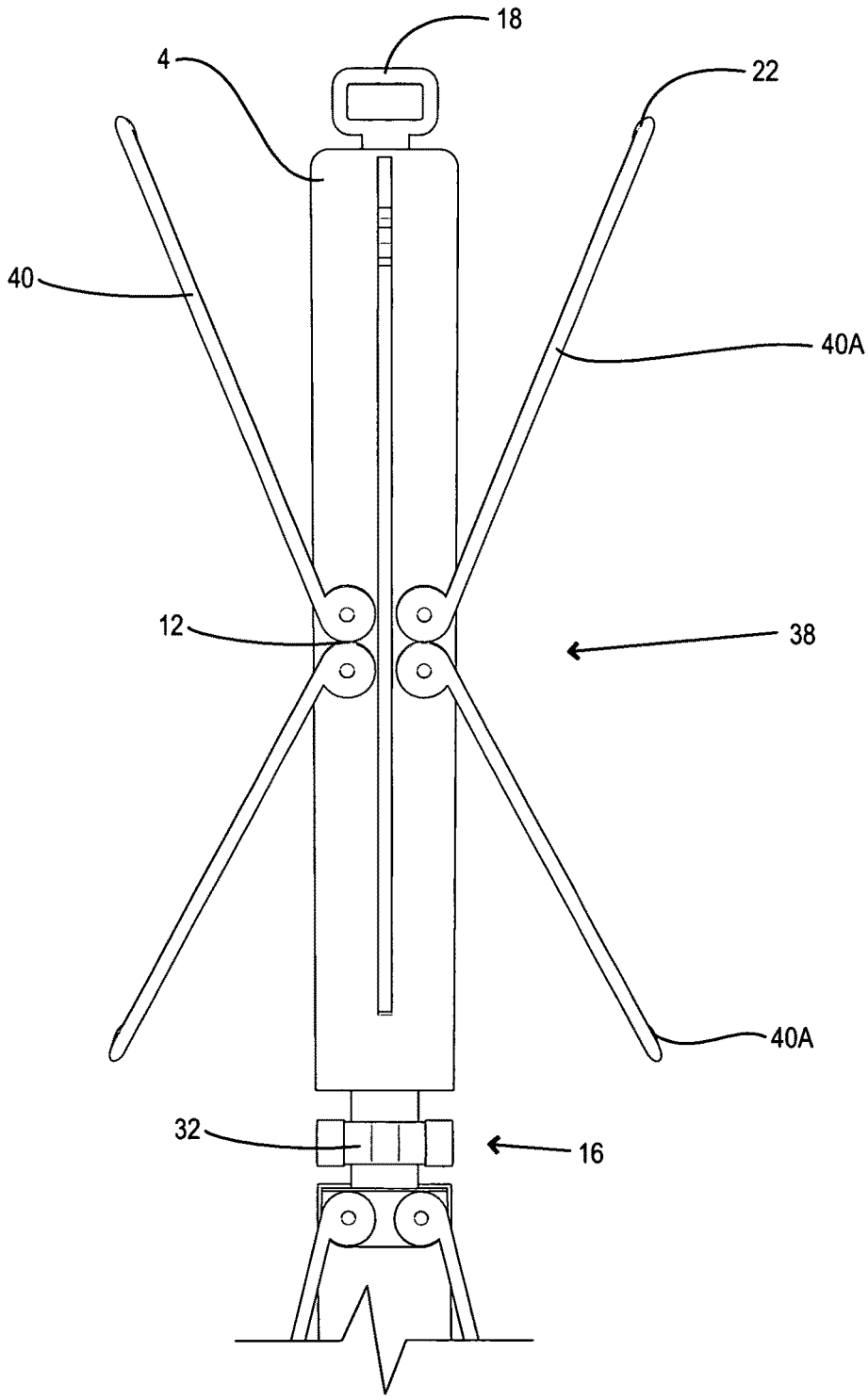
FIG. 10 is a rear view of an alternate configuration of the easel of FIG. 2.

Referring now generally to the Figures and particularly to FIG. 10, FIG. 10 is a rear view of an alternate configuration 38 of the easel 2. In this alternate configuration 38, rather than having a set of upper and lower arms 8, 10 instead two pivot arms 40 mounting at the same anchor point 12 act to support turn chart 34. An individual pivot arm 40 includes both a securing feature 22 at its peak and a holding feature 24 and its base. In as much as one pivot arm 40 must be behind the other in order to physically occupy the same anchor point 12, the securing feature 22 and holding feature 24 of the posterior pivot arm 40A, are enlarged to match up with the features 22, 24 of the adjoining pivot arm 40.

Figure 11:
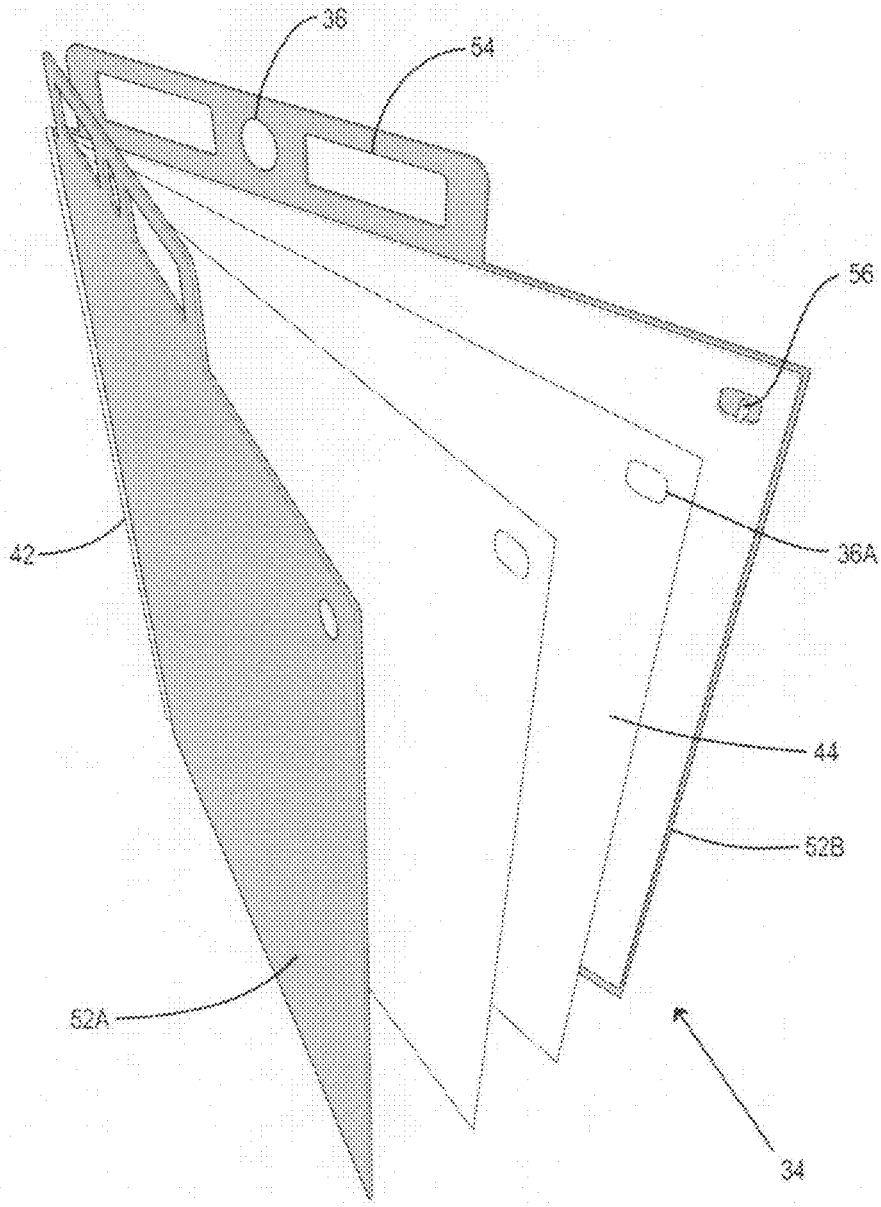
FIG. 11 is a side view of an invented turn chart of FIG. 2, showing multiple sheets.
Figure 12:
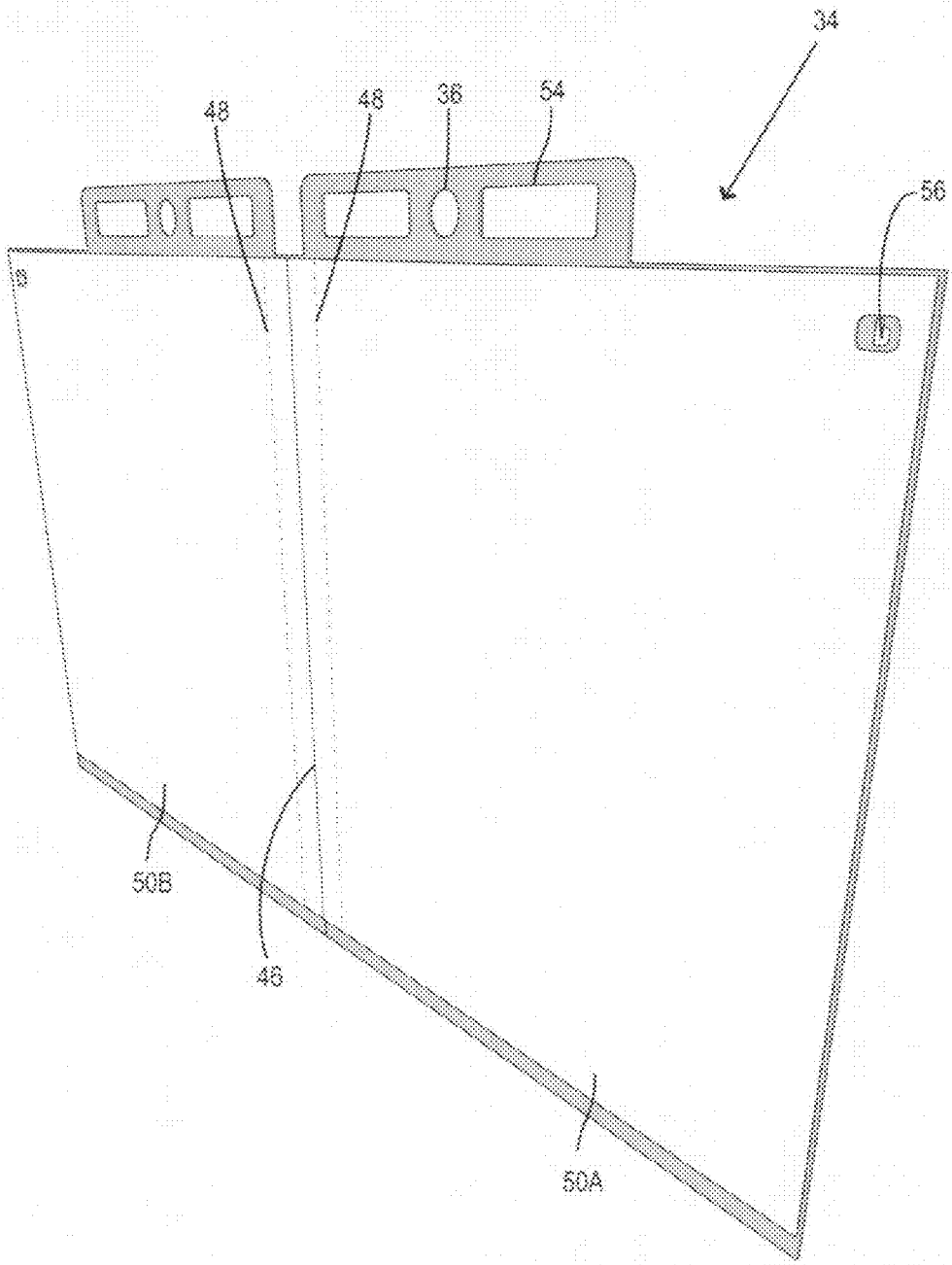
FIG. 12 is a front view of the turn chart of FIG. 11, showing an open configuration.
Figure 13:
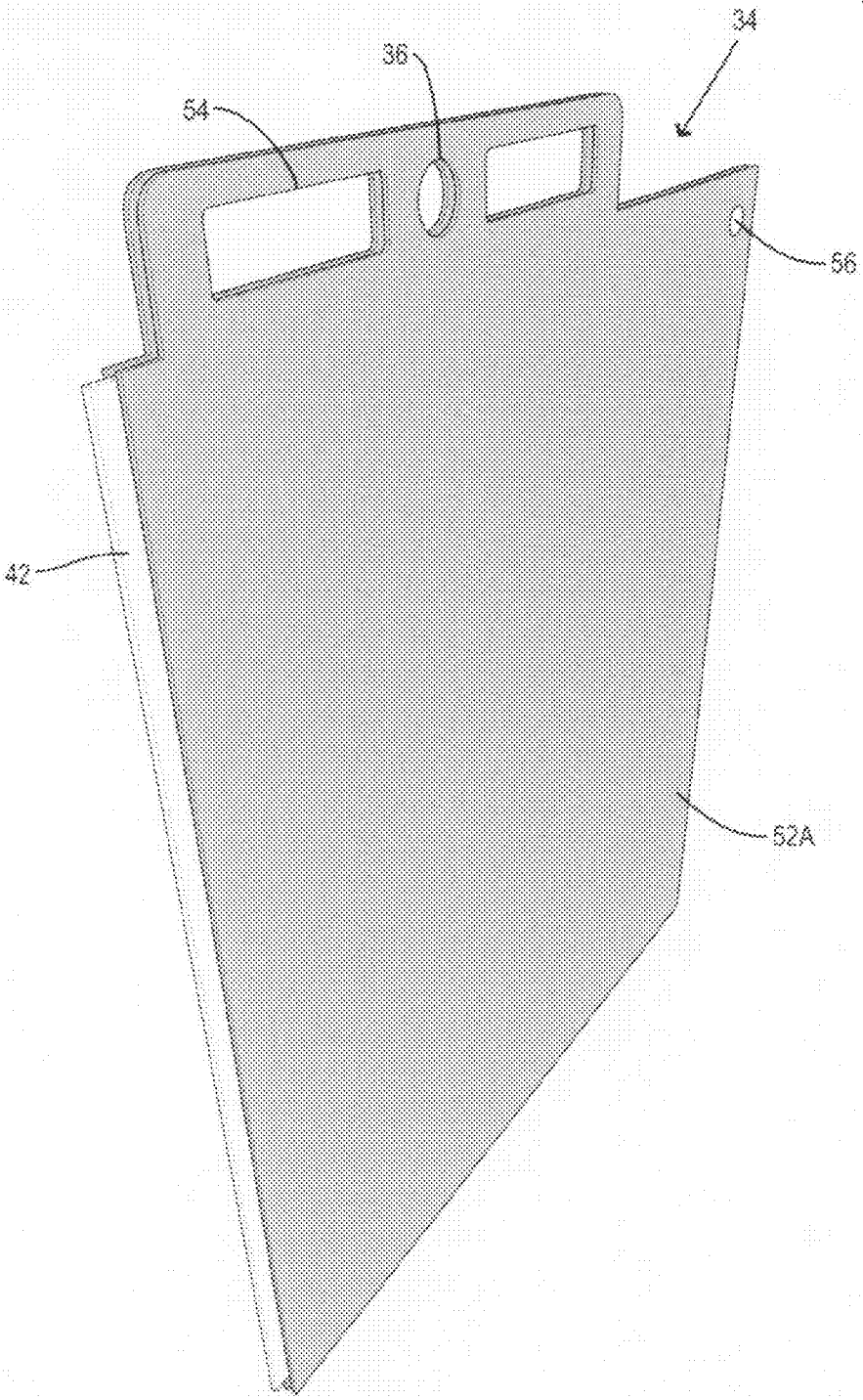
FIG. 13 is a rear view of the turn chart of FIG. 11, showing an attachment spine.

Referring now generally to the Figures and particularly to FIGS. 11, 12 and 13, FIG. 11 is a side view of the turn chart 34, showing multiple sheets 44, while FIG. 12 is a front view of the turn chart 34, showing an open configuration and FIG. 13 is a rear view of the turn chart 34, showing an attachment spine 42. The turn chart 34 includes a plurality of sheets 44 are bound by the attachment spine 42 and which may be flipped in a lateral direction. One or more sheets 44 may optionally be between one-thousandth and three one-thousandths thick and. The sheets 44 can optionally be made of cellulose pulp, recycled material, or other suitable material known in the art. Additionally these sheets 44 can take on any shape or color, though preferred configurations will include an essentially linear attachment edge 46. The sheets 44 may also include perforations 48 that are spread along an axis substantially parallel to, i.e. plus or minus 15 degrees from, the length of the attachment spine 42. The sheets 44 due to their flipping in a lateral direction may make use of both a front surface 50A and a back surface 50B for writing or display.

The turn chart 34 may be placed on the easel 2, or a suitable prior art easel known in the art, and have a first sheet 44 situated wholly to a user's left of the attachment spine 42, and with a second sheet to a user's right of the attachment spine 42. Users comfortable with reading from the left to the right, or from the right to the left, along a horizontal orientation may thus sense the turn chart 34 as having a layout of a published book or magazine. Turning the sheets 44 of the turn chart 34 to present a new or additional presentation surface 51 may be experienced by a user or observer as similar to the look and feel of turning the pages of a hard copy bound book.

In addition, a user can visually present more data or information on the presentation surface 51 than on a single sheet 44, and each sheet 44 may be separately removed form the turn chart 34 for attachment to a wall or other structure. Information may thus be grouped into topics and visual representations of information associated with a given topic may presented on a single sheet 44 and the single sheet may be separated from the turn chart 34 along a line of perforations 48. The separated sheet 44 may then be relocated from the turn chart 34 and visual presentation elsewhere. Simultaneously, other information may be continued to be visually presented from a second sheet 4 of a same writing surface 51 but is left on display by the easel 2.

The turn chart 34 may additionally include a front cover 52A and back cover 52B. Each cover 52A & 52B may include support apertures 36 for use in conjunction with the securing features 22, of the invented easel 2 and a handle 54 for use in transport.

Figure 14:
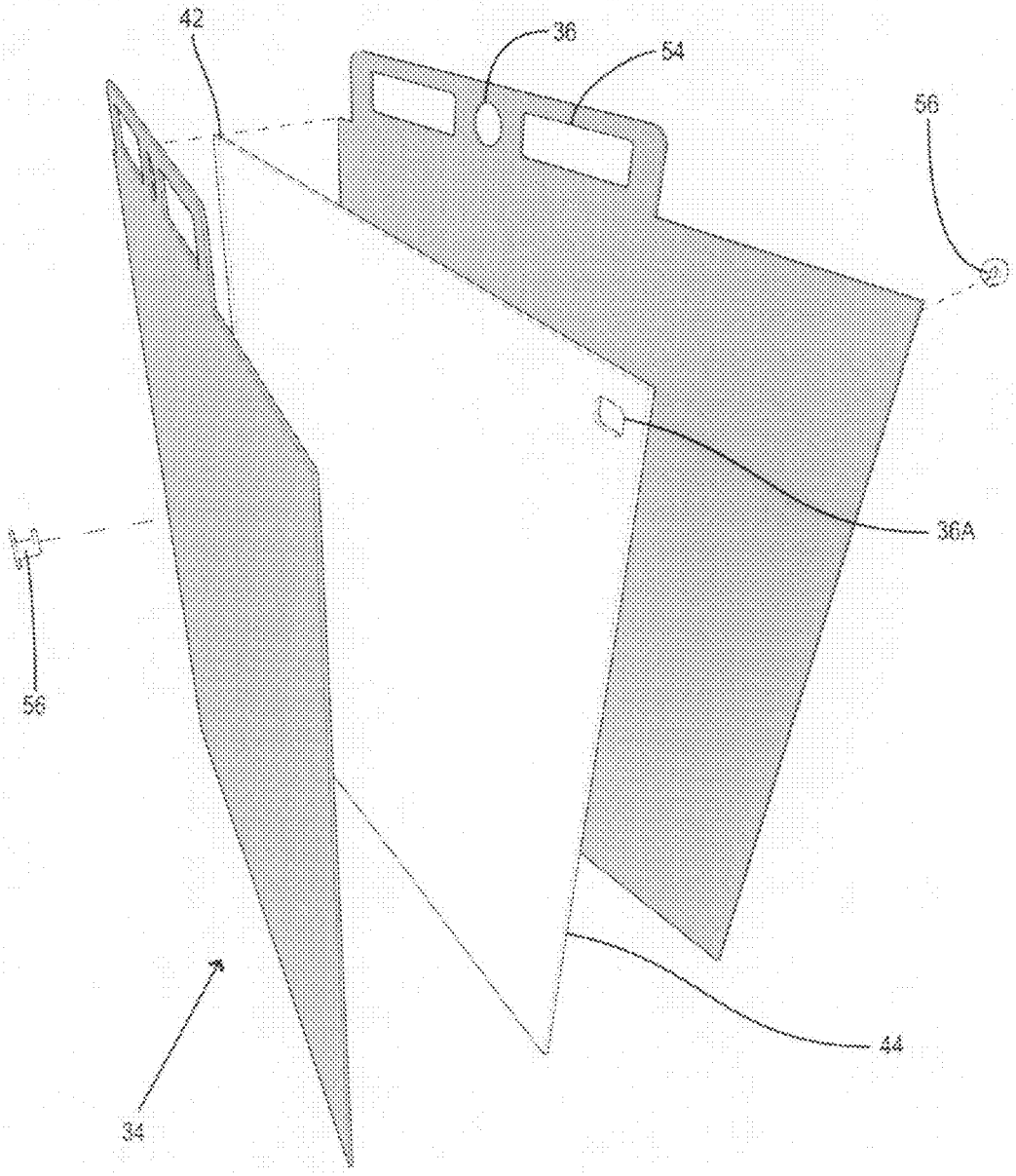
FIG. 14 is an exploded view of the turn chart of FIG. 11, showing construction therein.
Figure 15:
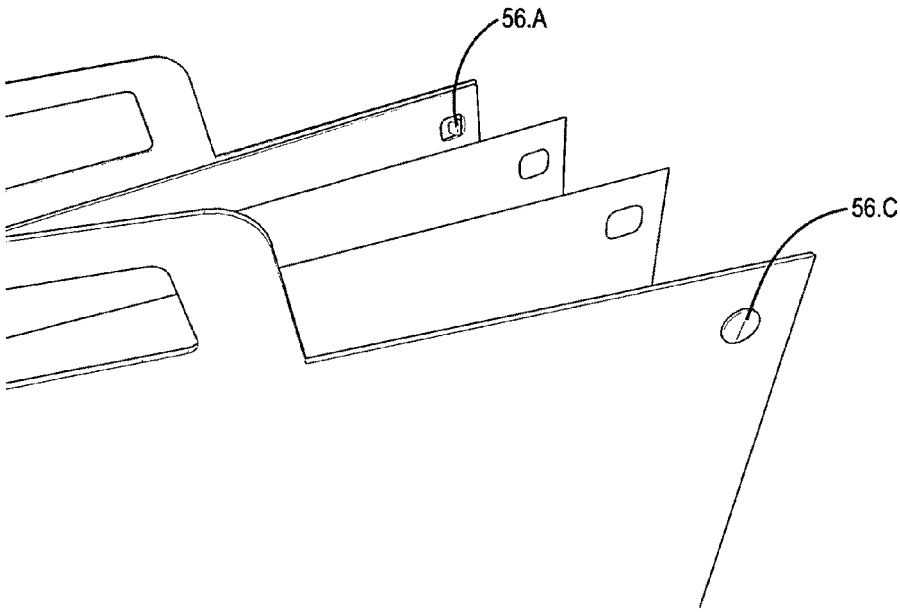
FIG. 15 is a view of several options for a cover support feature of the turn chart of FIG. 1.
Figure 15:
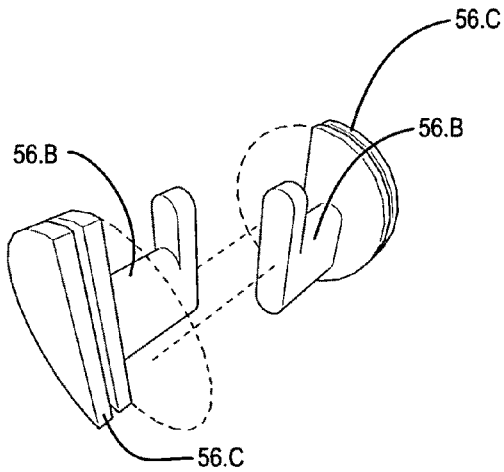
Figure 15:
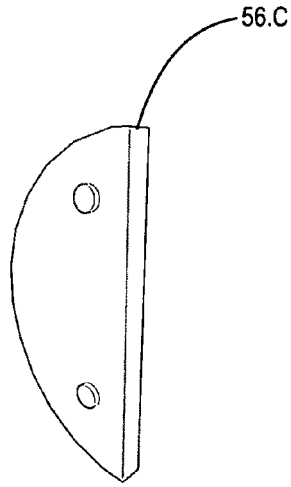

Referring now generally to the Figures and particularly to FIGS. 14 and 15, FIG. 14 is an exploded view of the turn chart 34 showing construction therein, while FIG. 15 is a view of several options for a cover support feature 56. The cover 52 of the turn chart 34, in its top outer corner, may include cover support features 56, to be used in conjunction with support apertures 36A in adjoining corners of the sheets 44. These cover support features 56 are used to support the weight of the sheets 44 and to keep said sheets 44 a flat writing surface for a user. Optionally the cover support features 56A may match the shape and diameter of the support apertures 36A, having length enough that the combined they match the thickness of the plurality of sheets 44. Alternatively the cover support features 56B may match half the shape and diameter of the support apertures 36A and each have a length in which the entire plurality of sheets 44 may be supported, and when closed the two separate halves 56.B1 and 56.B2 meet flush. An additional option for the cover support feature 56C comprises a hooked shape in which a plurality of sheets 44 may hang from.

Figure 16:
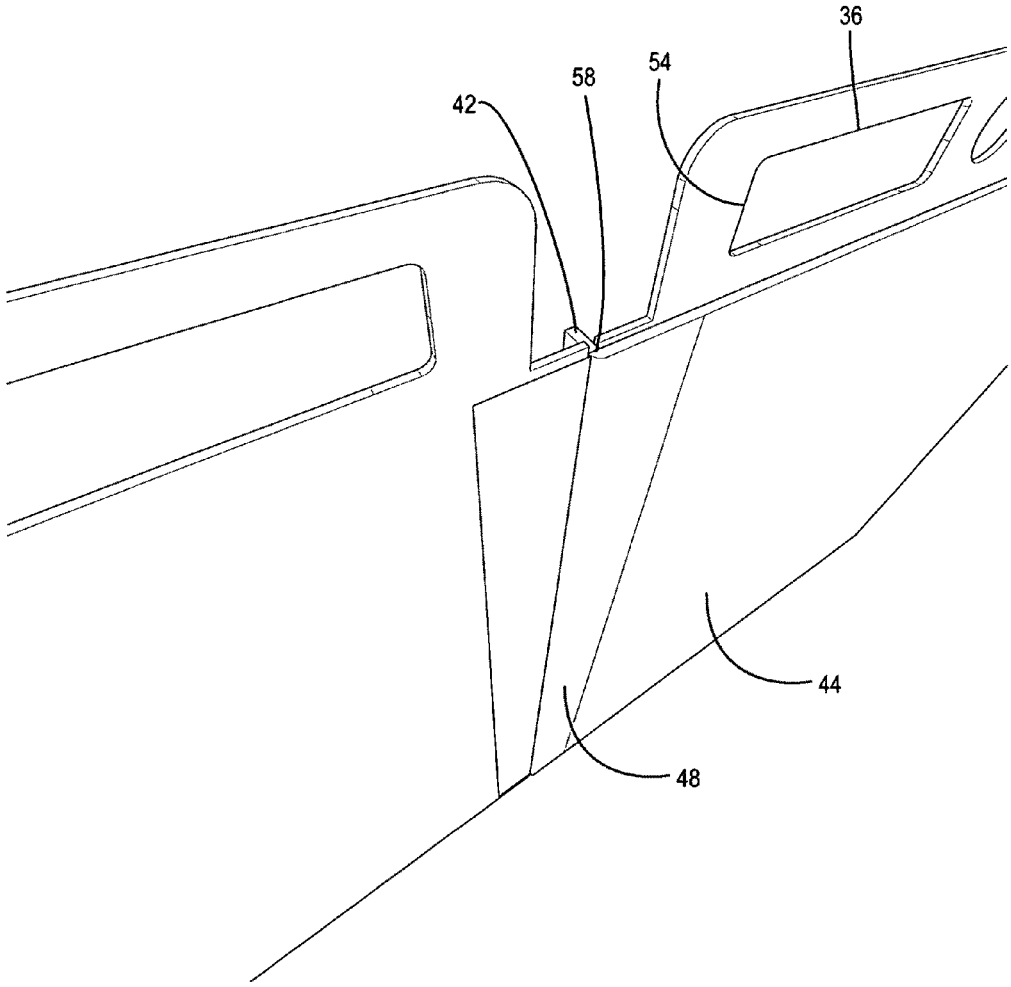
FIG. 16 is a close up, front view of an alternate configuration of the turn chart of FIG. 11 having an optional attachment spine.
Figure 17:
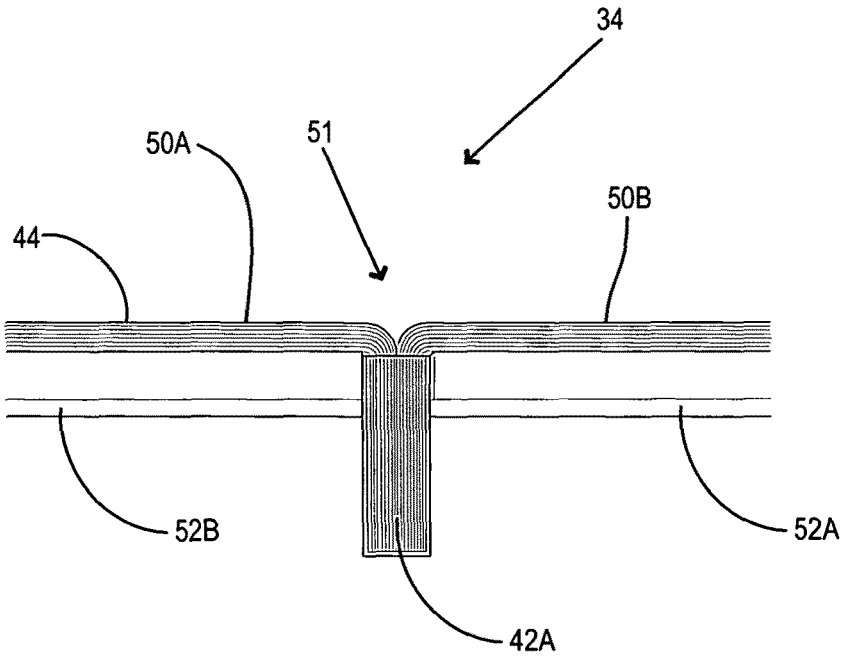
FIG. 17 is a top view of an alternate configuration of an alternate configuration of the turn chart of FIG. 11 having an arced attachment spine.

Referring now generally to the Figures and particularly to FIGS. 14, 16, 17 and 18; FIG. 14 is an exploded view of the turn chart 34 showing construction therein, while FIG. 16 is a close up, front view of the turn chart 34 showing an attachment spine and FIG. 17 is a top view of an alternate configuration of an turn chart 34 having a shaped attachment spine 42A. The shaped attachment spine 42A supports sheets 44 of the turn chart 34, such as the plurality of sheets 44 and the optional covers 52A and 52B and may be formed in a variety of ways known in the art either by a tight bond between a plurality of sheets 44 through either an adhesive 58 or bindings, or alternatively a shaped attachment spine 42A may be used in order to give the shaped spine 42A an arced shape to support a leveling of the writing surface 51 of the sheets 44 formed by a front surface 50A of one sheet 44 and a back surface 50B of a neighboring sheet 44. This shaped attachment spine 42A can be made from plastic metal, or any suitable material known in the art and may be bound to either a plurality of sheets 44 or to the supporting spine 4 in various configurations of the easel 2 and the turn chart 34.

Figure 18:
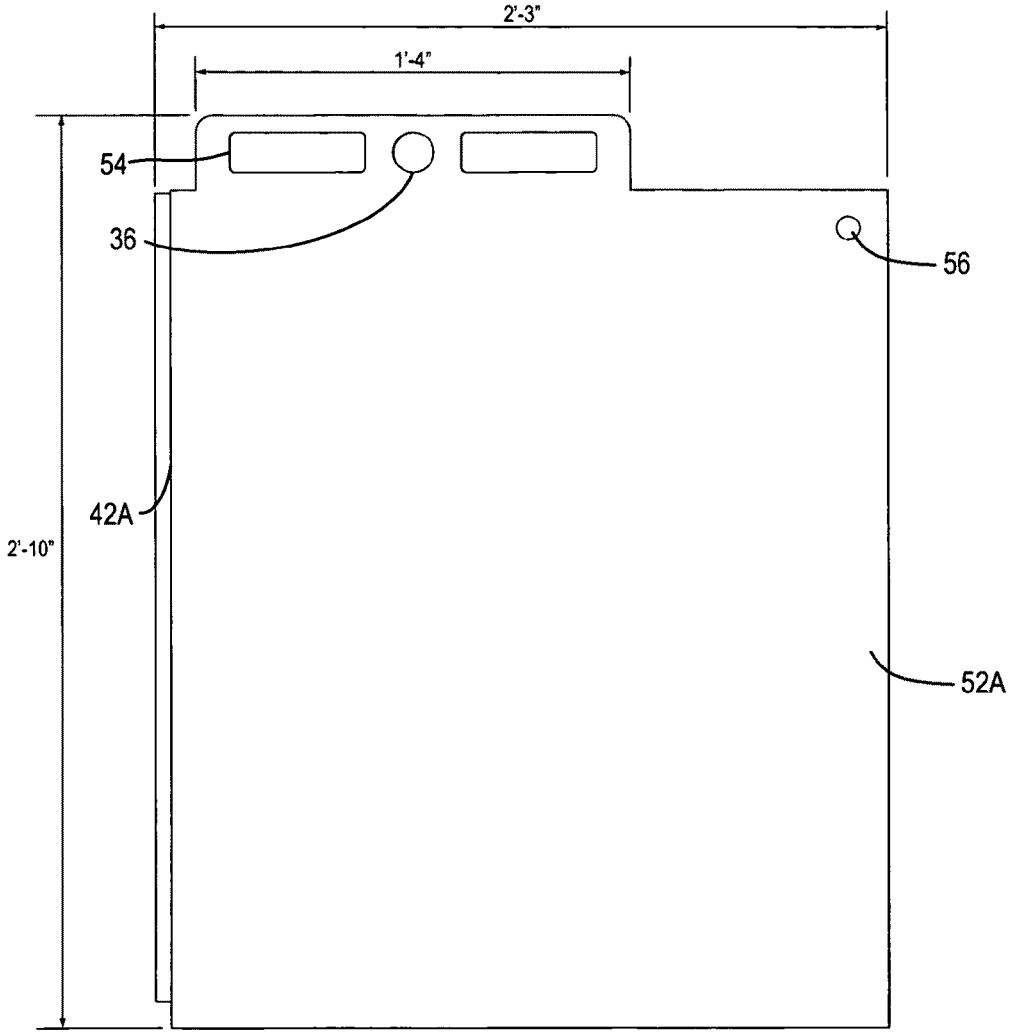
FIG. 18 is a side view of an alternate configuration of the turn chart of FIG. 11, having preferred dimensions.

FIG. 18 is a side view of the turn chart 34, showing preferred dimensions of certain alternate aspects 36, 42, 52A, 56, and 54 of the turn chart 34.

The foregoing disclosures and statements are illustrative only of the Present Invention, and are not intended to limit or define the scope of the Present Invention. The above description is intended to be illustrative, and not restrictive. Although the examples given include many specificities, they are intended as illustrative of only certain possible configurations or aspects of the Present Invention. The examples given should only be interpreted as illustrations of some of the preferred configurations or aspects of the Present Invention, and the full scope of the Present Invention should be determined by the appended claims and their legal equivalents. Those skilled in the art will appreciate that various adaptations and modifications of the just-described preferred embodiments can be configured without departing from the scope and spirit of the Present Invention. Therefore, it is to be understood that the Present Invention may be practiced other than as specifically described herein. The scope of the present invention as disclosed and claimed should, therefore, be determined with reference to the knowledge of one skilled in the art and in light of the disclosures presented above.

What is claimed is:

1. A flip chart for substantive vertical positioning by means of an external support feature, the flip chart comprising:

(a.) a plurality of sheets, each sheet forming an attachment edge, a first surface and a second surface;

(b.) an attachment spine, the attachment spine coupled to each sheet along each sheet attachment edge, the attachment spine enabling the plurality of sheets to alternate between an open position and a closed position, wherein in the closed position a plurality of first surfaces are each pressed against one of the plurality of second surfaces, and in the open position the plurality of first surfaces and a plurality of second surfaces are substantially co-planar; and (c.) a cover, the cover coupled with the attachment spine and providing a first handle and a second handle the first handle and the second handle extending away from the plurality of sheets, at least one support aperture and two handle apertures, the cover adapted to support the weight of the flip chart, and each the first handle forming a first handle aperture and a support aperture, and the second handle forming a second handle aperture, wherein the first handle aperture and the second handle aperture are located equidistant from the attachment spine and adapted for accepting a same human hand when the cover is in the closed position, whereby the flip chart is foldable and manually transportable in the closed position, and the at least one support aperture is adapted to receive the external support feature while the first surface and the second surface are substantively positioned vertically and the plurality of sheets are in the open position.

2. The flip chart of claim 1, wherein the second handle further comprises a second support aperture, the adapted to receive a second external support feature and support the weight of the flip chart while the first surface and the second surface are substantively positioned vertically.

3. The flip chart of claim 2, wherein the support aperture and the second support aperture are located equidistant from the attachment spine.

4. The flip chart of claim 2, wherein the plurality of sheets each comprise a sheet support aperture and the cover further comprises a cover support feature, the cover support feature adapted to extend simultaneously through each sheet support aperture.

5. The flip chart of claim 1, wherein the plurality of sheets each comprise a sheet support aperture and the cover further comprises a cover support feature, the cover support feature adapted to extend simultaneously through each sheet support aperture.

6. The flip chart of claim 5, wherein the cover support feature is adapted to simultaneously bear the full weight of the plurality of sheets.

7. The flip chart of claim 1, wherein the sheets are a solid color.

8. The flip chart of claim 1, wherein at least one surface of one sheet displays a signage.

9. The flip chart of claim 1, wherein at least a first surface of a first sheet and a second surface of a second sheet display a unified signage.

10. The flip chart of claim 1, wherein each attachment edge is essentially straight.

11. The flip chart of claim 1, wherein each first surface and second surface are rectangular.

12. The flip chart of claim 11, wherein the attachment edge presents the longest linear dimension of the sides of each rectangular surface.

13. The flip chart of claim 1, wherein the attachment spine comprises an adhesive.

14. The flip chart of claim 1, wherein at least one sheet is perforated along an axis parallel with the attachment spine.

15. The flip chart of claim 14, wherein the perforation is positioned within 0.5 inches of the attachment spine.

16. A flip chart comprising:

(a.) a first cover comprising a first handle, the first handle forming a first handle aperture and a first support aperture;

(b.) a second cover comprising a second handle, the second handle forming a second handle aperture;

(c.) a plurality of sheets disposed between the first cover and the second cover, each sheet forming an attachment edge, a first surface and a second surface; and (d.) an attachment spine, the attachment spine coupled to the first cover, the second cover and each sheet along the attachment edge, wherein the first handle aperture and a second handle aperture, wherein the first handle aperture and the second handle aperture are each located equidistantly from the attachment spine and the first support aperture is adapted to support the weight of the flip chart while the first surfaces and the second surfaces of the plurality of sheets are positioned substantively vertically.

17. The flip chart of claim 16, wherein the plurality of sheets comprises cellulose pulp.

18. The flip chart of claim 16, wherein the plurality of sheets comprises recycled material.

19. The flip chart of claim 16, further comprising a first cover support feature, the first cover support feature configured to extend from the first cover and to maintain a sheet proximate to the first cover.

20. The flip chart of claim 19, further comprising a second cover support feature, the second cover support feature configured to extend from the second cover and to maintain a sheet proximate to the second cover.

* * * * *